US005624230A

United States Patent [19]

Taylor et al.

[11] Patent Number: 5,624,230

[45] Date of Patent: Apr. 29, 1997

[54] CEILING FAN AIR FRESHENER DIFFUSION DEVICE

[76] Inventors: John C. Taylor; Becky M. Taylor, both of 5512 Crescent Dr., North Little Rock, Ark. 72118-3538

[21] Appl. No.: 580,068

[22] Filed: Dec. 20, 1995

[51] Int. Cl.[6] ..... F01D 25/00

[52] U.S. Cl. ..... 416/5; 416/146 R; 422/124

[58] Field of Search ..... 416/5, 93 R, 95, 416/146 R; 422/124, 125

[56] References Cited

U.S. PATENT DOCUMENTS

| | | | |
|---|---|---|---|
| 4,666,670 | 5/1987 | Cox | 416/5 |

FOREIGN PATENT DOCUMENTS

| | | | |
|---|---|---|---|
| 2614535 | 11/1988 | France | 422/124 |
| 3-138489 | 6/1991 | Japan | 416/146 R |
| 387704 | 2/1933 | United Kingdom | 416/5 |

*Primary Examiner*—Edward K. Look
*Assistant Examiner*—Mark Sgantzos
*Attorney, Agent, or Firm*—Jerry L. Mahurin

[57] ABSTRACT

A ceiling fan air freshener diffusion device comprising a scent receptive chamber, a removable drawer for holding a volatile scented medium and a heater for volatilizing the scent medium. The chamber comprises a housing defining a cap for mounting to the hub of a ceiling fan and a continuous sidewall extending downward from the cap. The sidewall defines scent diffusion orifices and a drawer receptive opening. A floor is secured to the housing, abutting the sidewall to seal the housing. An adjustment baffle captivated between the floor and the cap also defines scent diffusion control orifices for regulating diffusion of scent in conjunction with the scent diffusion orifices defined in the sidewall. A tab extending from the baffle through an adjustment slot in the side wall is used to control the aperture defined by the sidewall and baffle orifices together. The preferred embodiment uses a switched resistance heating element located within a base below the floor of the chamber to volatilize the scent medium. The base comprises a bottom and upwardly projecting walls. The base defines orifices to receive a lighting kit. Alternatively, byproduct heat from the fan motor or one or more lights can be used to volatilize the scent medium contained within the drawer.

20 Claims, 5 Drawing Sheets

CEILING FAN AIR FRESHENER DIFFUSION DEVICE

BACKGROUND OF THE INVENTION

The present invention broadly relates to scent diffusion. Specifically, the present invention is a Ceiling Fan Air Freshener Diffusion Device. Art pertinent to the subject matter of the present invention can be found in U.S. Patent Class 422, Subclasscs 124 and 125 and Class 416 Subclass 5.

As one skilled in the art would expect numerous patents have been issued on ceiling fan related inventions. Many devices have been patented which are attached to the blades of a ceiling fan. An air filter disposed on the blades of a ceiling fan is disclosed in McKnight, U.S. Pat. No. 4,753,573. Teal, U.S. Pat. No. 4,782,213, discloses a set of electric resistance heaters mounted in a set of fan blades in conjunction with louvers. U.S. Pat. No. 5,383,765, issued to Baxter, discloses an air Freshener adapted to be hooked on the blades of a ceiling fan.

An electric heater disposed in the base of a ceiling fan, against the ceiling, is disclosed in Lee, U.S. Pat. No. 5,425,126. Monrose, U.S. Pat. No. 5,077,825, discloses an electric heater mounted to the hub of a ceiling fan, extending below the fan.

Several patents assigned to S. C. Johnson & Son, Inc. deal with electrically heated air fresheners. Weyenberg, U.S. Pat. No. 4,145,001, discloses packaging for controlled release of a volatile scent. Martens, U.S. Pat. No. 4,849,606, discloses a tamper resistant container for air freshener cartridges. Van Lit, U.S. Pat. No. 4,391,781 speaks to an electrically heated vapor dispenser.

Finally, Cox, U.S. Pat. No. 4,666,670, discloses a mesh potpourri holder intended to be suspended from the hub of a ceiling fan.

The prior art fails to disclose a heat activated scent diffusion device intended to be incorporated with a ceiling fan.

Hence, it is desirous to provide a ceiling fan air freshener diffusion device which uses heat electrically generated or heat produced by the fan or associated lights as a by-product to release a volatile scent to be defused by air circulated by the ceiling fan or ambient air currents.

SUMMARY OF THE INVENTION

My ceiling fan air freshener diffusion device employs the location and air circulation ability of a ceiling fan to disperse an air freshening scent. The preferred embodiment is an after-market unit which may be mounted to the hub of a conventional ceiling fan. In turn, a light kit may be mounted to my device. My diffusion device comprises a chamber receiving a volatile scent medium drawer. Also, the preferred embodiment employs a heater for volatilizing the scented medium, while alternative embodiments use the byproduct heat generated by the fan motor and/or lights to volatilize the scent medium.

The scent receptive chamber comprises a housing, defining sidewalls extending downward from a cap, and a floor, closing the housing. An adjustment baffle is captivated within the housing between the cap and the floor. The device is mounted to the hub of a ceiling fan through holes defined in the cap. Scent diffusion orifices defined in the sidewall and the baffle align to provide a vent aperture to control diffusion of scent. A tab extending from the baffle through a slot defined in the sidewall controls the vent aperture. The orifices may be of several different decorative shapes such as diamonds, circles, ellipses or filigree. The drawer passes through an opening in the sidewall into the chamber. The scent medium disposed within the drawer may be a potpourri or similar substance; or, tile medium itself may be volatile or semivolatile such as a nonflammable scented oil or gel. The generally rectangular drawer has an open top and an exterior knob. The interior end of the drawer has a pair of interconnected prongs for insertion into a receptacle within the housing.

The resistance heating element or power resistor employed by the preferred embodiment is disposed within a heated base defined below the floor. The base is defined by a bottom adapted to mount a light kit and walls extending upward from the bottom. Accessory wiring within the ceiling fan hub, intended to provide power to a light kit, supplies current to the element via the receptacle in the housing and an external switch. The interconnected prongs on the drawer control the flow of current to the heating element. Wiring for a light kit can simultaneously be connected to the fan wiring and passed through the device.

Alternative embodiments would incorporate the scent diffusion device into the structure of the ceiling fan motor housing, replace the hub of the ceiling fan or the base of a light kit. These alternative embodiments could use the ambient heat produced by the fan motor or light kit, or they could employ a switched resistive heater similar to the preferred embodiment.

Therefor a primary object of my ceiling tan air freshener diffusion device is to freshen room air as a ceiling fan circulates tile air.

An object of my ceiling fan air freshener diffusion device is to take advantage of the location of a ceiling fan to disperse a scent whether or not the ceiling fan is in operation.

An object of my device is to employ the easy access to AC voltage at the bottom hub panel of ceiling fan to power my air freshener diffusion device.

Conversely, an object of my device is to employ the byproduct heat of a ceiling fan and/or an associated light to defuse a volatile scent medium.

An object of my device is to provide a ceiling fan air freshener diffusion device which may be mounted between a ceiling fan and light kit.

An object of my device is to employ a variety of scent mediums for diffusion by a ceiling fan.

An object of my device is to provide regulation of the dispersion of scent by vents that slide shut.

An object of my device is to provide a scent diffusion device which can be incorporated into light kits by an original equipment manufacturer.

An object of my device is to provide a scent diffusion device which can be incorporated into a ceiling fan by an original equipment manufacturer.

An object of my device is to provide a scent diffusion device which can be operated by an on/off switch.

An object of my device is to provide a scent diffusion device which employs a slide drawer to hold a variety of scent mediums.

An object of my device is to provide a scent diffusion device which can be manufactured of brass, metal, chrome, plastic or wood.

An object of my device is to provide scent diffusion devices which when installed on multiple ceiling fans in various areas or rooms could use single scents for all areas to provide a homogenous environment.

An alternative object of my device is to provide scent diffusion devices which when installed on multiple ceiling fans in various areas or rooms could provide different scent zones or individual scent areas.

An object of my device is to provide a scent diffusion device which can be operated by an electronic timer.

An object of my device is to provide a scent diffusion device which can be operated by a wall control.

An object of my device is to provide a scent diffusion device which can be operated by a remote control.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
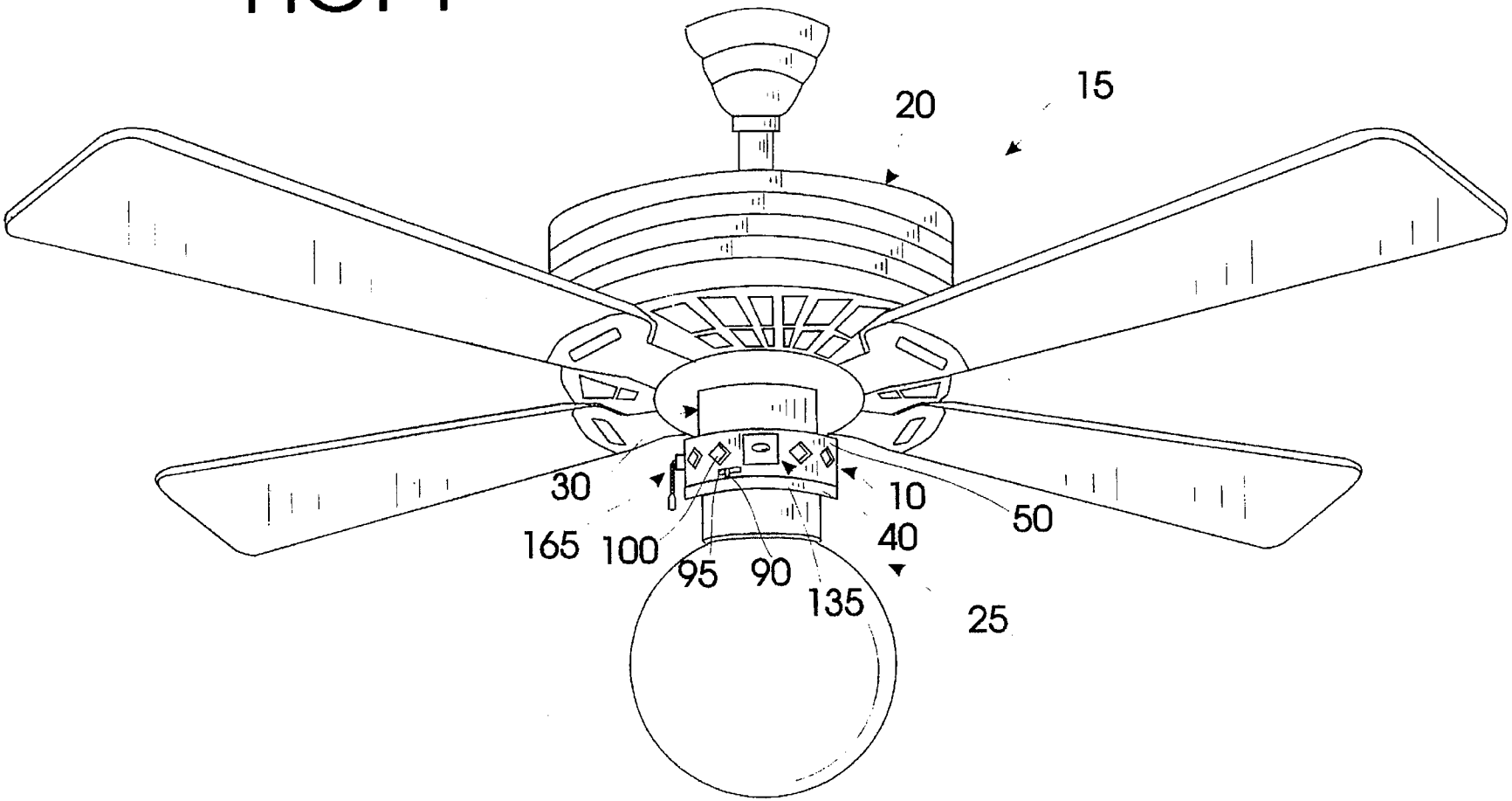
FIG. 1 is an environmental, isometric view of a my Ceiling Fan Air Freshener Diffusion Device mounted on a ceiling fan with a light kit.
Figure 2:
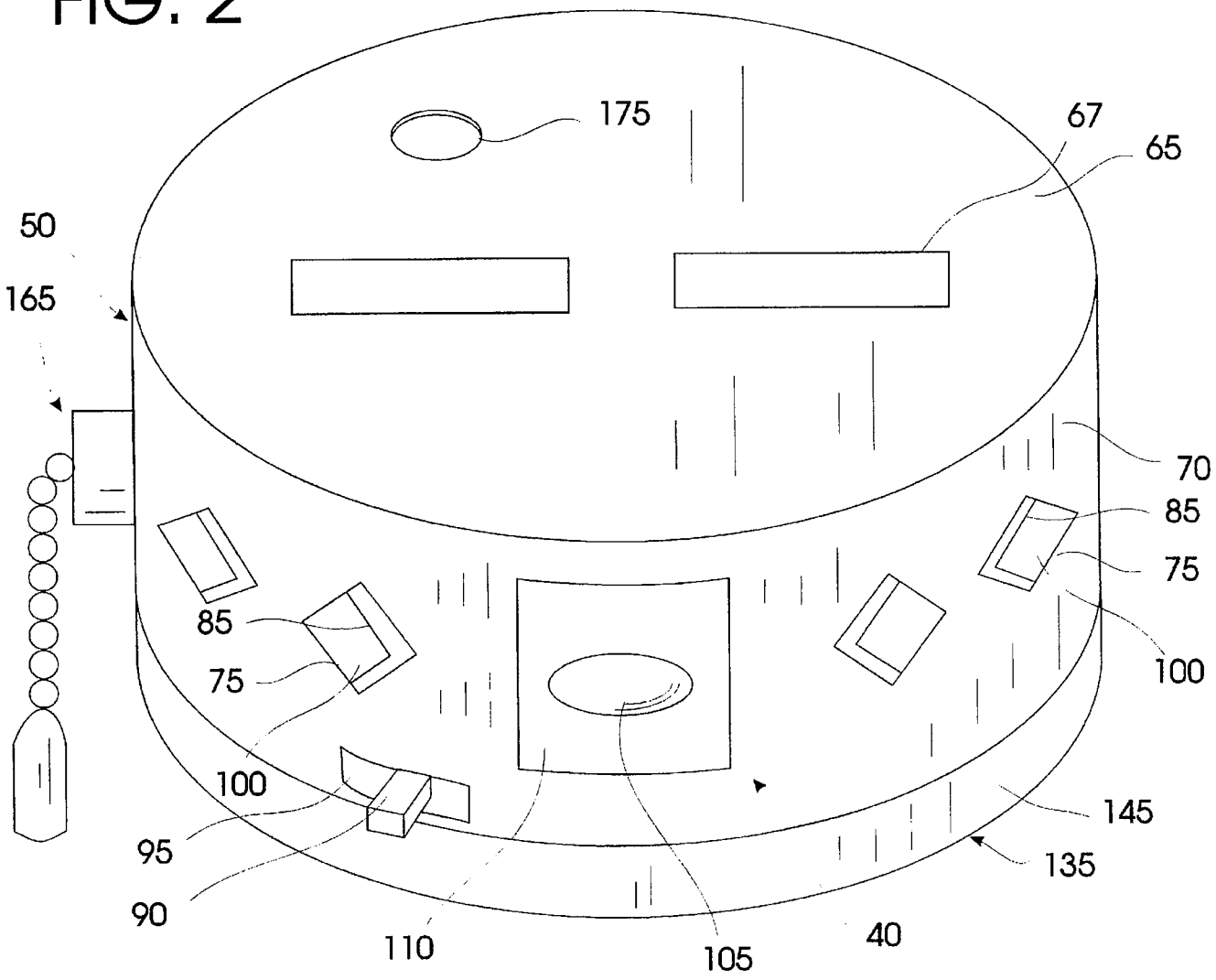
FIG. 2 is an isometric view of my device.
Figure 3:
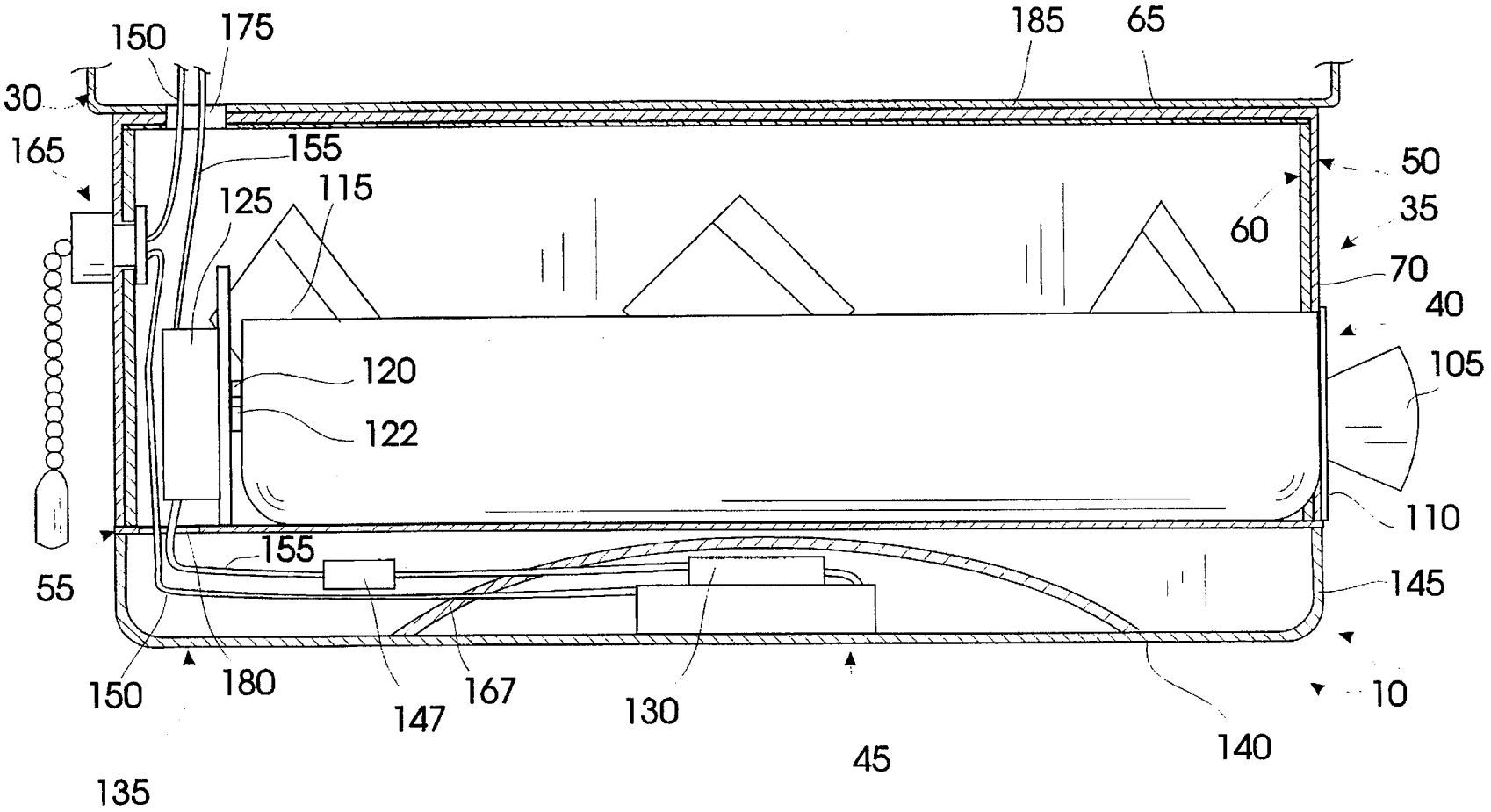
FIG. 3 is a fragmented side view of my device mounted to the hub of a ceiling fan with the portions omitted for clarity.

With reference now to the accompanying drawings, the preferred embodiment of my ceiling fan air freshener diffusion device is broadly designated by the reference numeral 10. It is deployed in conjunction with a ceiling fan 15. It may be integrated with the casing 20 of the ceiling fan motor or it can be manufactured into an after-market lighting kit 25 to be mounted to the hub 30 of a ceiling fan 15. However, the illustrated preferred embodiment 10 is an after-market unit which may be mounted to the hub 30 of a conventional ceiling fan 15. Additionally, a conventional after-market light kit 25 may be mounted to my device 10 as illustrated in FIG. 1.

My ceiling fan air freshener diffusion device 10 comprises a scent receptive chamber 35 and a removable drawer 40 received within the chamber 35 for holding a volatile scented medium. Further, the preferred embodiment employs a heater 45 for volatilizing the scented medium.

The scent receptive chamber 35 comprises a housing 50, a floor 55 and an adjustment baffle 60 captivated within the housing 50. The housing 50 comprises a cap 65 for mounting the device 10 to the hub 30 of a ceiling fan 15 via mounting slots 67 and a continuous sidewall 70 extending downward from the cap 65. Scent diffusion orifices 75 are defined in the sidewall 70. The sidewall orifices 75 may be of several different decorative shapes such as the illustrated diamonds. Other possible shapes include circles, ellipses or filigree. An opening 80 is defined in the sidewall 70 to receive the scent medium drawer 40. The floor 55 is secured to the housing 50, abutting the sidewall 70 to seal the chamber 35. The floor 55 is secured to the housing 50 by screws via orifices 82. The semicircular adjustment baffle 60 is captivated between the floor 55 and the cap 65. The baffle 60 defines scent diffusion control orifices 85 which in cooperation with the sidewall orifices 75 regulate diffusion of scent. The baffle 60 further comprises an adjustment tab 90 extending from an adjustment slot 95 in the housing 50. The baffle 60 is displaced using the tab 90 to align the orifices 85 and 75 in the baffle 60 and the sidewall 70 allowing the desired vent aperture 100 and scent diffusion. A gasket 102, captivated between the baffle 60 and the cap 65, seals the chamber 35 off from the interior of the fan casing 20 preventing the escape of fumes from the chamber 35 into the motor casing 20. The gasket 102 defines mounting orifices 103 to align with the mounting slots 67 to facilitate mounting the device 10 to the hub 30 of a ceiling fan 15.

The scent receptive drawer 40 receives a medium impregnated with a volatile scent. For example, the medium might be a potpourri or a similar substance. Alternatively, the medium itself may be volatile or semivolatile such as a nonflammable, scented oil or gel. Preferably, the drawer 40 is an open top, rounded corner, parallelepiped with an exterior knob 105 and a slightly enlarged face 110. The interior end 115 of the drawer 40 mounts a set of interconnected prongs 120 and 122 for insertion into a receptacle 125 within the chamber 35.

The scent medium may be volatilized by excess heat from the ceiling fan motor or a light 25 mounted to the ceiling fan 15. However, the preferred embodiment 10 employs a heating element 130 to volatilize the scent medium. The heating element 130 is disposed within the base 135 of the device 10 mounted below the floor 55. The base 135 comprises a bottom 140, upwardly projecting walls 145 extending from the bottom 140 and an electrically operated heating element 130 disposed within the base 135. Screws are threaded into bosses 138 extending downward from the floor 55. The bottom defines a pair of orifices 137 to receive screws to mount the base 135 to the rest of the unit 10. Preferably the heating element 130 is a resistance heater of the type referred to as a power resistor. It is controlled by an overload switch or thermostat 147. Current is supplied to tile element 130 by wires 150 and 155, which are connected to wiring within the fan 15. An external switch 165 is employed to control the flow of current to the resistance heating element 130. Flow of current is further controlled by the receptacle 125 within the housing 50. The drawer 40 acts as a switch to regulate the flow of current to the heating element 130. When the drawer 40 is in place the interconnected prongs 120 and 122 allow a flow of current through the receptacle 125. A heat dissipation shield 167 disposed over the element 130 disperses the heat generated by the element 130. The wires within the fan 15 are generally intended for use with a lighting kit 25. A lighting kit 25 may be mounted to a pair of holes defined in the bottom 140 of the base 135. These holes are backed by bosses 170 to receive mounting screws. Wiring tier the light kit 25 can be connected to the fan wiring also and passed through the scent diffusion device 10 through wiring through-holes 175 and 180.

Figure 4:
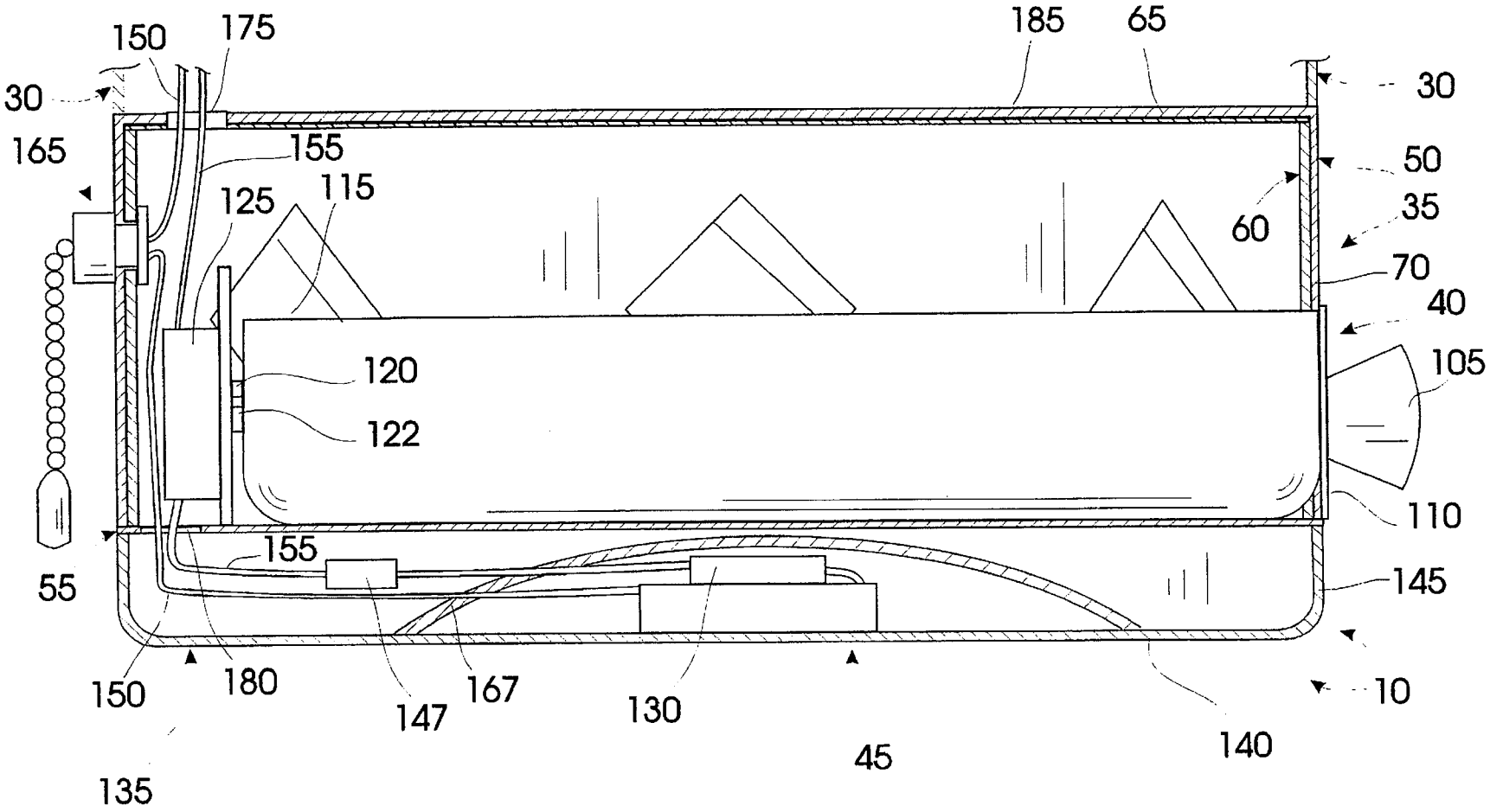
FIG. 4 is a fragmented side view of an alternative deployment of my device replacing the hub cover of a ceiling fan with the portions omitted for clarity; and, FIG. 5 is an exploded isometric view of the preferred embodiment of my device with tile drawer omitted for clarity.
Figure 5:
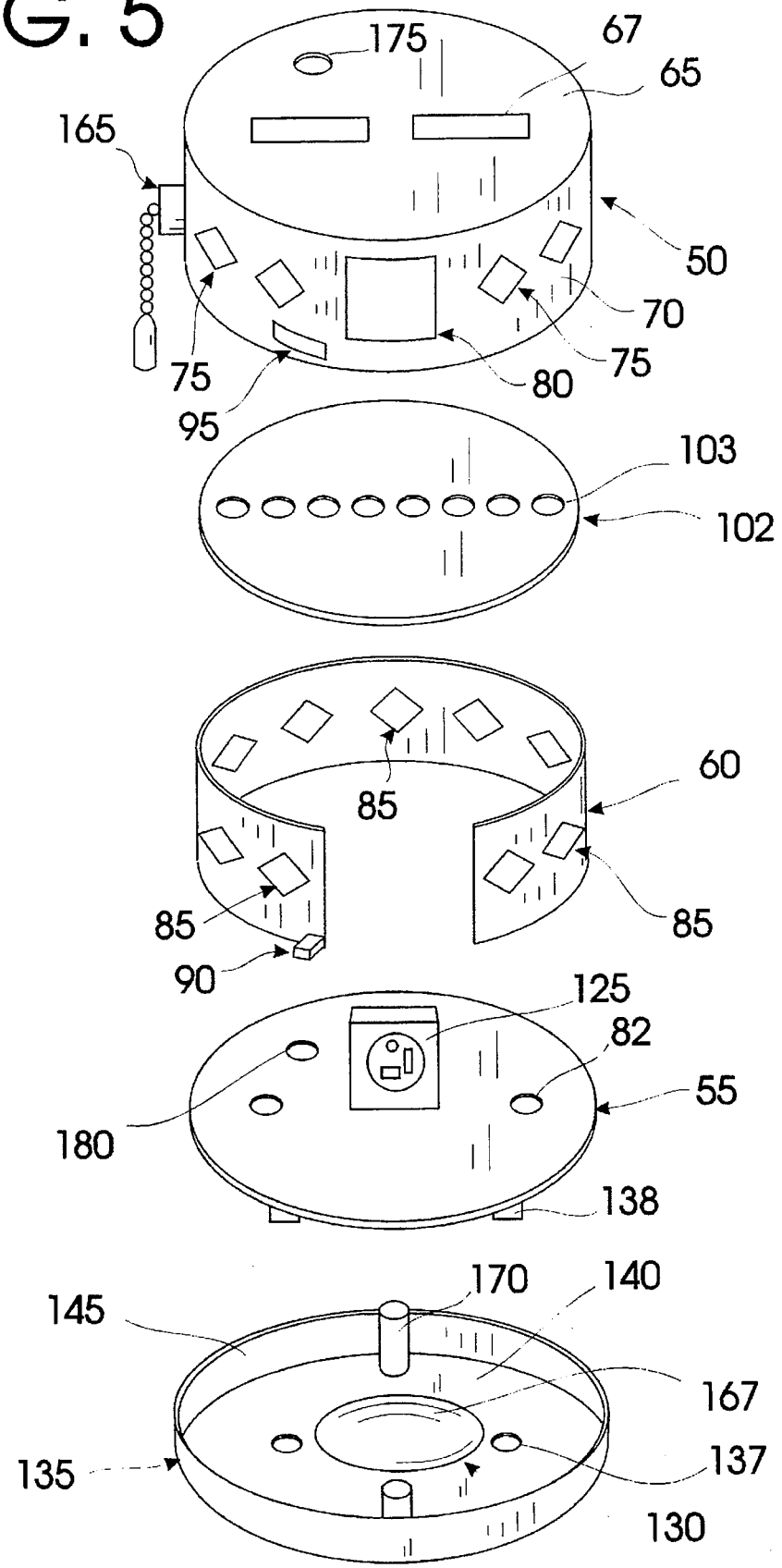

Alternative embodiments cited above call for the scent diffusion device 10 to be incorporated into the structure of the ceiling fan 15 or a light kit 25 itself. For example, the device 10 could entirely replace the hub cover 185 of the ceiling fan (FIG. 4) or even the hub 30 itself. Alternatively, a light kit 25 could incorporate my device 10 as a housing for the wiring of the light kit 25 for mounting to tile hub 30 of the ceiling fan 15.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A ceiling fan air freshener diffusion device comprising:

a scent receptive chamber, said chamber comprising:

a housing comprising a cap for mounting to a ceiling fan and a continuous sidewall extending downward from said cap, said sidewall defining scent diffusion orifices and a drawer receptive opening;

a floor secured to said housing, abutting said sidewall;

a removable drawer for holding a volatile scented medium, said drawer received by said drawer receptive opening for insertion of said drawer into said chamber; and, volatilization means for heating said scent medium.

2. The diffusion device as defined in claim 1 further comprising an adjustment baffle captivated between said floor and said cap, against said sidewall within said chamber, said baffle defining scent diffusion control orifices for regulating diffusion of scent by adjustment of said baffle relative to said sidewall scent diffusion orifices to form scent diffusion vent apertures.

3. The diffusion device as defined in claim 2 wherein said volatilization means comprises byproduct heat produced by said ceiling fan and an electric light associated with said ceiling fan during operation.

4. The diffusion device as defined in claim 1 wherein said volatilization means comprises an electrically operated heating element disposed within a base defined below said floor, said base comprising a bottom and upwardly projecting walls abutting said floor.

5. The diffusion device as defined in claim 2 wherein said volatilization means comprises an electrically operated heating element disposed within a base defined below said floor, said base comprising a bottom and upwardly projecting walls abutting said floor.

6. The diffusion device as defined in claim 5 wherein said cap is secured to a hub of said ceiling fan.

7. The diffusion device as defined in claim 6 wherein said bottom defines orifices to mount a light kit.

8. A ceiling fan air freshener diffusion device adapted to be mounted to a ceiling fan, said device comprising:

a housing comprising a cap for mounting to said ceiling fan and a continuous sidewall, said sidewall defining scent diffusion orifices and a drawer receptive opening;

a floor secured to said housing, abutting said sidewall forming a scent receptive chamber;

an adjustment baffle captivated between said floor and said cap, against said sidewall within said chamber, said baffle defining scent diffusion control orifices for regulating diffusion of scent by adjustment of said baffle relative to said sidewall scent diffusion orifices to form scent diffusion vent apertures;

a removable drawer for holding a volatile scent medium, said drawer received by said drawer receptive opening for insertion of said drawer into said chamber;

a base defined below said floor, said base comprising a bottom defining upwardly projecting walls, abutting said floor; and, volatilization means for heating said scent medium.

9. The diffusion device as defined in claim 8 wherein said volatilization means comprises byproduct heat produced by said ceiling fan during operation.

10. The diffusion device as defined in claim 9 wherein said volatilization means further comprises byproduct heat produced by at least one electric light associated with said ceiling fan.

11. The diffusion device as defined in claim 8 wherein said volatilization means comprises an electrically operated heating element disposed within said base.

12. The diffusion device as defined in claim 8 wherein said cap is secured to a hub of said ceiling fan.

13. The diffusion device as defined in claim 8 wherein said cap is a hub cover of said ceiling fan.

14. The diffusion as defined in claim 12 wherein said base comprises orifices to mount a light kit.

15. An air freshener diffusion ceiling fan said ceiling fan comprising:

a central motor casing adapted to be suspended from a ceiling;

a motor operatively disposed within said casing;

a plurality of fan blades for circulating ambient air operatively mounted on said motor;

a housing comprising a cap for mounting to said casing and a continuous sidewall, said sidewall defining scent diffusion orifices and a drawer receptive opening;

a floor secured to said housing, abutting said sidewall, said housing and floor defining a scent receptive chamber;

an adjustment baffle captivated between said floor and said cap within said chamber, adjacent said sidewall, said battle defining scent diffusion control orifices for regulating diffusion of scent by adjustment of said baffle orifices relative to said sidewall orifices to define scent diffusion vent apertures; and, a removable drawer for holding a volatile scent medium, said drawer received by said drawer receptive opening for insertion of said drawer into said chamber.

16. The diffusion device as defined in claim 15 wherein said volatile scent medium is volatilized by byproduct heat produced by said ceiling fan during operation.

17. The diffusion device as defined in claim 16 wherein said volatile scent medium is further volatilized by byproduct heat produced by at least one electric light associated with said ceiling fan.

18. The diffusion device as defined in claim 15 further comprising a base defined below said floor, said base comprising a bottom defining upwardly projecting walls.

19. The diffusion device as defined in claim 18 further comprising an electrically operated heating element disposed within said base for volatilizing said scent medium.

20. The diffusion device as defined in claim 19 wherein said base comprises orifices to mount a light kit.

* * * * *